US008746592B2

(12) United States Patent
Lo

(10) Patent No.: US 8,746,592 B2
(45) Date of Patent: Jun. 10, 2014

(54) SPRINKLER

(75) Inventor: Shun Nan Lo, Changhua County (TW)

(73) Assignee: Yuan Mei Corporation, Changhua County (TW)

( * ) Notice: Subject to any disclaimer, the term of this patent is extended or adjusted under 35 U.S.C. 154(b) by 700 days.

(21) Appl. No.: 12/571,663

(22) Filed: Oct. 1, 2009

(65) Prior Publication Data

US 2010/0193603 A1 Aug. 5, 2010

(30) Foreign Application Priority Data

Feb. 5, 2009 (TW) ..... 98103758 A

(51) Int. Cl.
*B05B 3/04* (2006.01)

(52) U.S. Cl.
USPC ..... 239/240; 239/113; 239/132.5; 239/263.3; 239/590

(58) Field of Classification Search
CPC ..... B05B 15/02; B05B 15/025; B05B 1/00; B05B 3/0422; B05B 3/0436
USPC ..... 239/112, 113, 132–132.5, 590, 590.3, 239/590.5, 553–553.5, 462, 575, 240–242, 239/263, 263.3
See application file for complete search history.

(56) References Cited

U.S. PATENT DOCUMENTS

| | | | |
|---|---|---|---|
| 5,052,621 | A | 10/1991 | Katzer et al. |
| 7,255,291 | B1 | 8/2007 | Lo |
| 7,419,105 | B2 | 9/2008 | Wang et al. |
| 7,422,162 | B2 | 9/2008 | Wang et al. |

FOREIGN PATENT DOCUMENTS

| | | | |
|---|---|---|---|
| DE | 3833984 | A1 | 6/1988 |
| EP | 0362559 | A2 | 2/1989 |

*Primary Examiner* — Christopher Kim
(74) *Attorney, Agent, or Firm* — Arthur Tan-Chi Yuan

(57) ABSTRACT

An improved sprinkler has a flow altering device to change water direction and control the direction of a blade wheel. A gear set causes a sprinkler head's repetitive rotation. The sprinkler head includes a set of corresponding upper plate and lower plate to divide an interior chamber of the sprinkler head to two chambers: a control chamber and a gear chamber. A water inlet pipe connects only with the control chamber to provide water to enter the control chamber. The upper plate and the lower plate form a filtering channel interconnecting between the control chamber and the gear chamber. The water from the control chamber can flow into the gear chamber through the filtering channel. The filtering channel filters the large/coarser particle debris in the water and the water flowing into the gear chamber can lubricate and cool the gear set in the gear chamber.

6 Claims, 13 Drawing Sheets

SPRINKLER

BACKGROUND OF THE INVENTION

1. Field of the Invention

Embodiments of the invention generally relate to an improvement on sprinkler head structure. In particular, aspects of the invention relate to a multi-chambered interior of the sprinkler head to alleviate damages thereto due to debris contained in water.

2. Background of the Invention

In one previously known technology, a common sprinkler includes an inlet pipe having water flowing into the interior of the sprinkler before the water exits from the nozzle of the sprinkler. After an extended use, debris of various sizes in the water enters the sprinkler without any filtering, and cause damages to the gears inside the interior of the sprinkler. Consequently, the operation of the sprinkler is interfered and the usage life of the sprinkler is reduced.

Similarly, other kinds of sprinkler describe a divided interior, but during operations, each gear may easily damaged when friction among the gears increases when the lubrication and cooling from the water decreases. As such, the temperature between the gear chamber and the control chamber will be different and the water pressure may concentrate in the control chamber. This phenomenon further leads to a lack of balance between the water pressure and temperature in the gear chamber. Also, in these existing designs, a driving pinion is exposed on the outside of the gear chamber and a blade rim meet with the driving pinion to cause a connected movement between one another. Consequently, the driving pinion and the blade rim are not enclosed completely inside the gear chamber. As such, they are easily affected negatively by external forces and the gears' operations will also be negatively affected. Also, because the driving pinion and the blade rim are exposed outside of the gear chamber, when the water flows from the control chamber to the gear chamber, the water will escape from the location where the driving pinion and the blade rim meet. As such, the gear chamber in these types of sprinklers must be completely separate from the water distribution system to prevent water seepage situation. This further prevents the gear chamber get proper lubrication and cooling from the water. In addition, even if lubricant were added in the gear chamber, the lubricant will still slowly leak from the blade in the un-enclosed gear chamber. Thus, eventually, the lubricant will be lost and the purpose of lubrication of the gear chamber using the lubricant will be lost as well.

BRIEF SUMMARY OF THE INVENTION

Aspects of the invention overcome deficiencies of prior technologies by providing an interconnected channel within the sprinkler head. Aspects of the invention provide an improved sprinkler that uses a movable piece which includes a gear chamber and a control chamber. A set of dividers or dividing plates or blades (an upper blade and a lower blade) separates the gear chamber and the control chamber. The separation forms or results a water filtering space to direct water to flow from the control chamber and prevent water with debris to enter the gear chamber. As such, the water from the control chamber can be filtered in the water filtering space, filtering out water with debris, before it enters the gear chamber. Thus, aspects of the invention not only provide lubrication and cooling from water to the gear set during its operations, but also protect the gear set by preventing an accumulation of debris. Aspects of the invention also ensure the smooth operations of the gear set and maintain a balanced water temperature and pressure between the gear chamber and the control chamber and achieve an optimal balance of the temperature and pressure.

Alternative aspects of the invention provide a gear set that is completely or substantially completely enclosed within the interior of the gear chamber of movable piece and can mesh with the blade of the main gear and the stationary gear of the inlet pipe. Such design ensures the complete protection of the gear chamber, prevents external interferences and prevents unexpected seepage of water from the gear chamber, and maintains the optimal usage condition of the sprinkler.

According to another aspect, an improved sprinkler includes a water switching device to change a water flow direction to control a blade and a direction of a gear set to oscillate a movable set. The sprinkler includes a set of an upper divider and a lower divider positioned within an interior of the movable set and dividing the interior of the movable set into a water control chamber and a gear chamber. The water control chamber includes a water switching device therein, and the gear chamber includes a gear set therein. The movable set includes a bottom end, and the bottom end of the movable set includes a connecting pipe with a stationary gear section. The stationary gear section meets with a gear within the gear set. The gear set is substantially or completely enclosed in the gear chamber, and the water flowing inside the connecting pipe is accessible to the control chamber only to direct water to the control chamber. The upper divider and the lower divider comprise a set of matching ribs and receiving grooves that form a water filtering space to enable the water from the control chamber to flow through the filtering space before seeping through the gear chamber while filtering out larger particles in the water and assisting in cooling and lubrication of the gear set. In another aspect, the As such, aspects of the invention further prevent frictional damages between gears in the gear set and to maintain the water pressure and temperature differences between water in the control chamber and the gear chamber.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
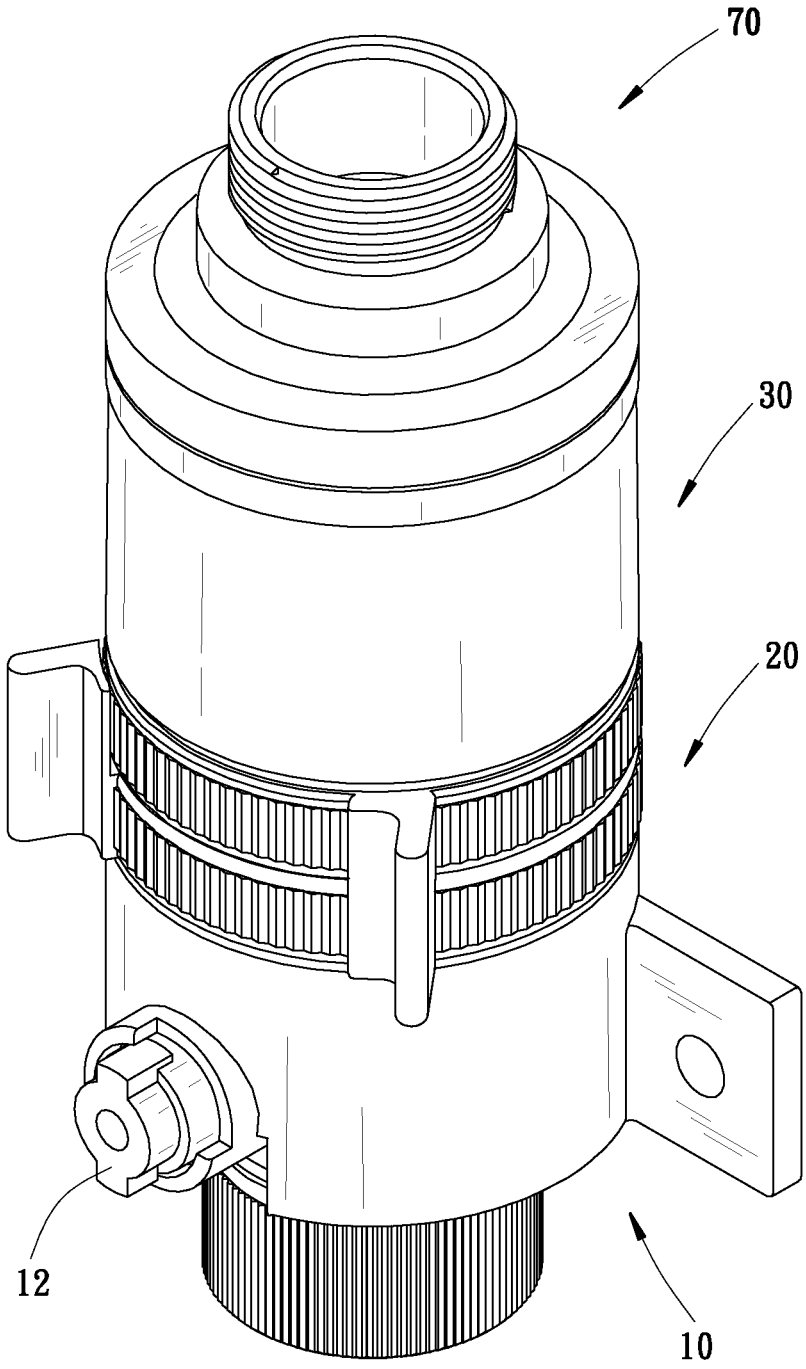
FIG. 1 is a perspective view of an embodiment of the invention.
Figure 2:
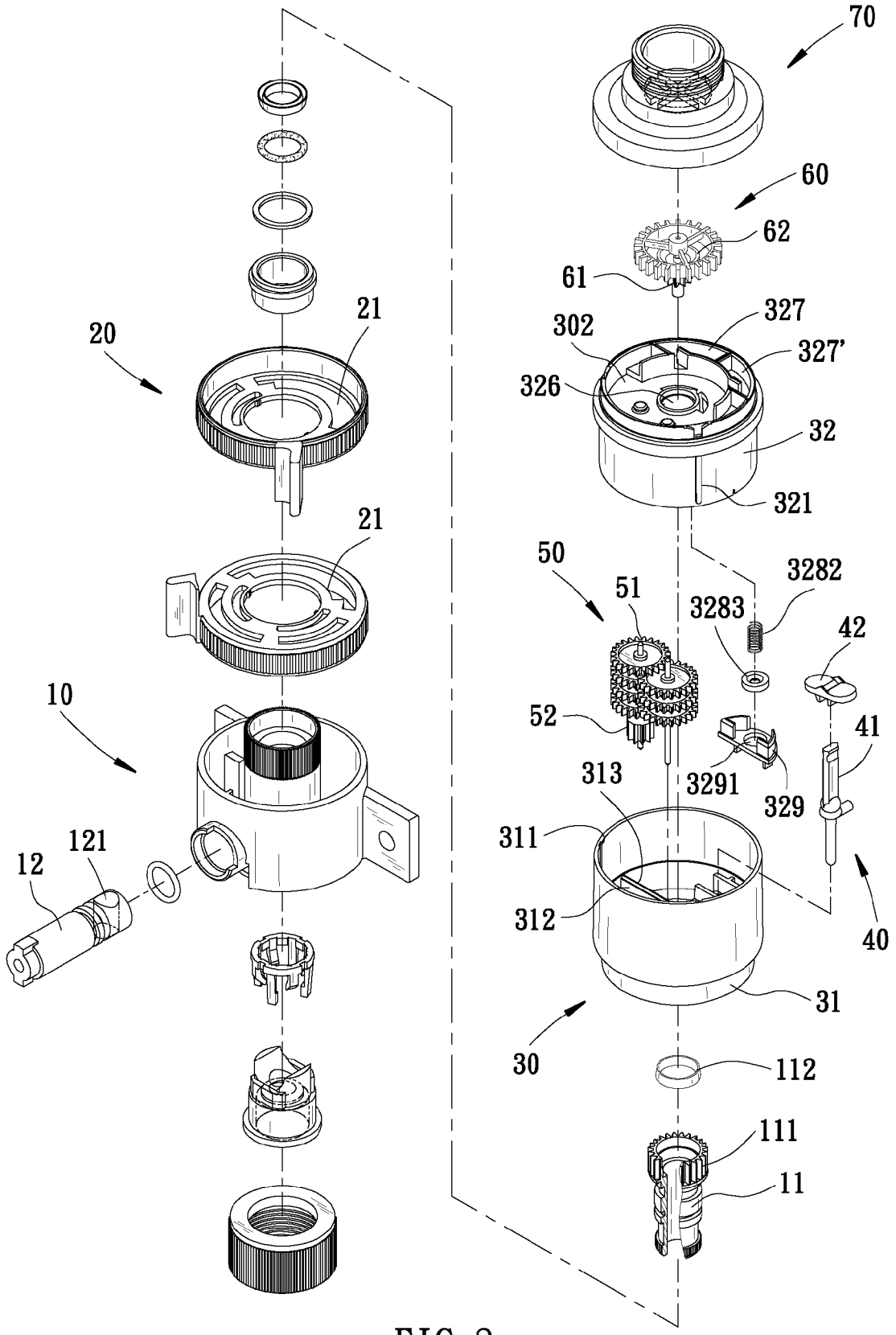
FIG. 2 is an exploding perspective view of an embodiment of the invention.
Figure 3:
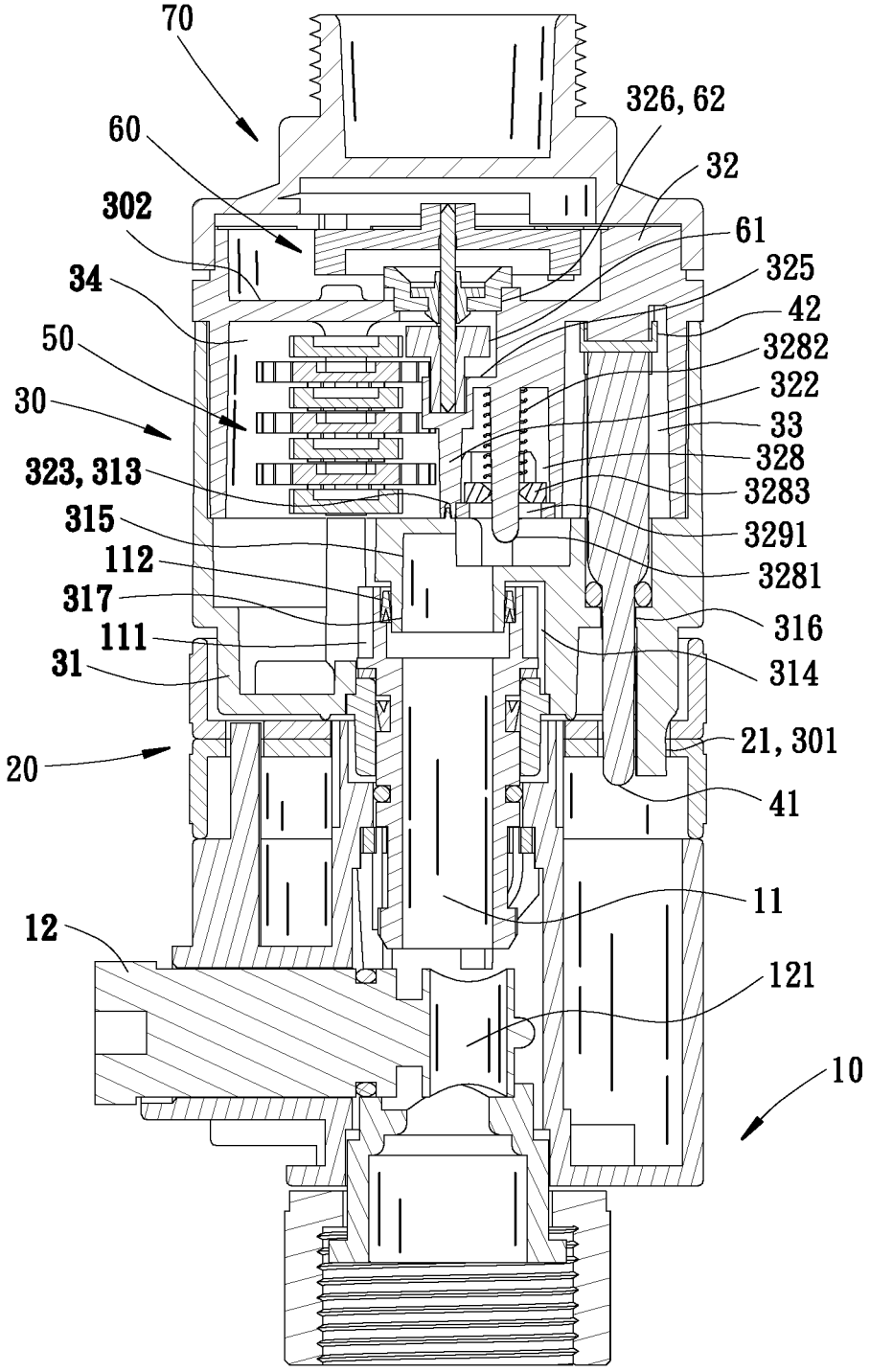
FIG. 3 is one cross-section view of an embodiment of the invention.
Figure 4:
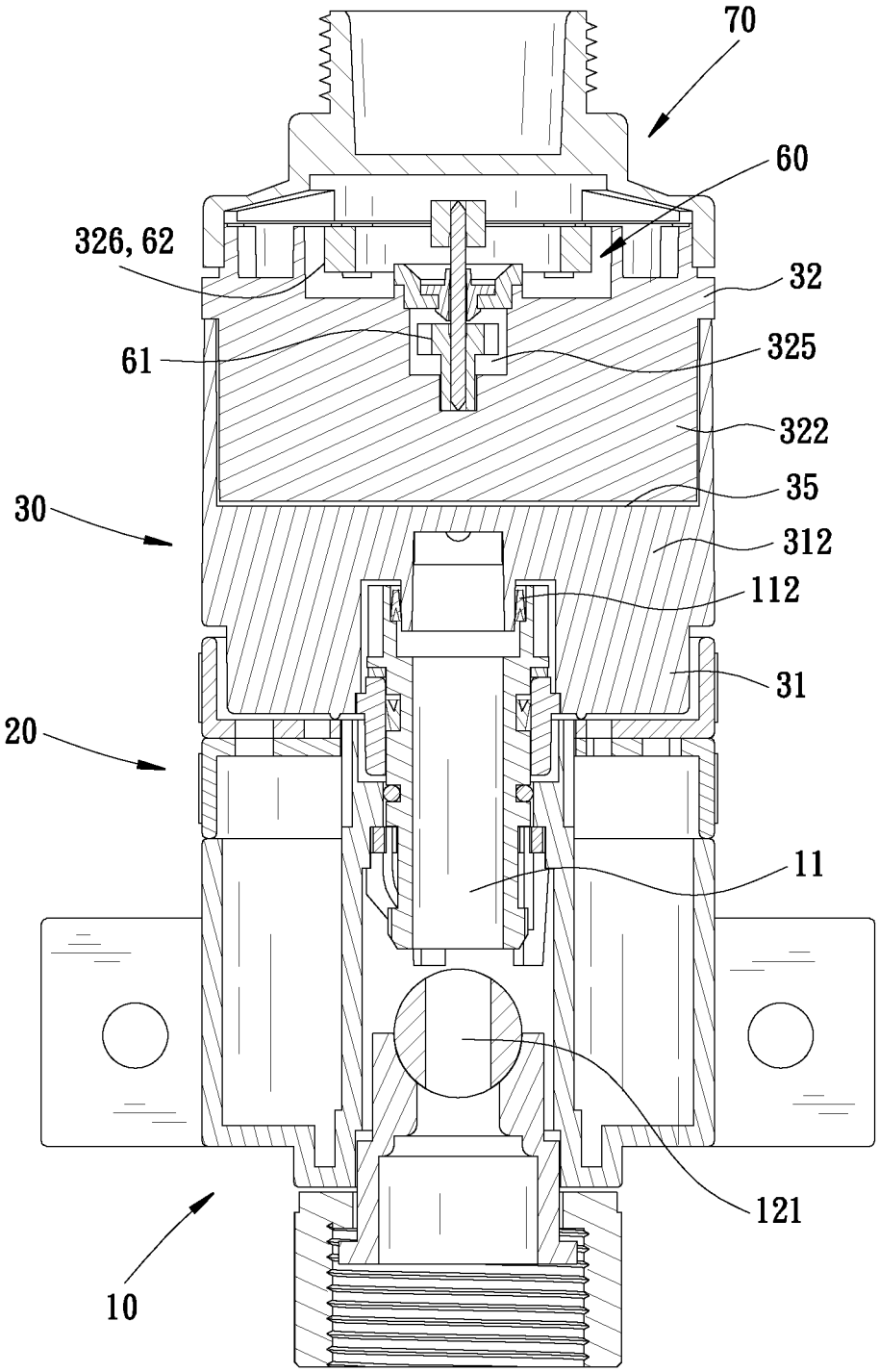
FIG. 4 is another cross-section view of an embodiment of the invention.
Figure 5:
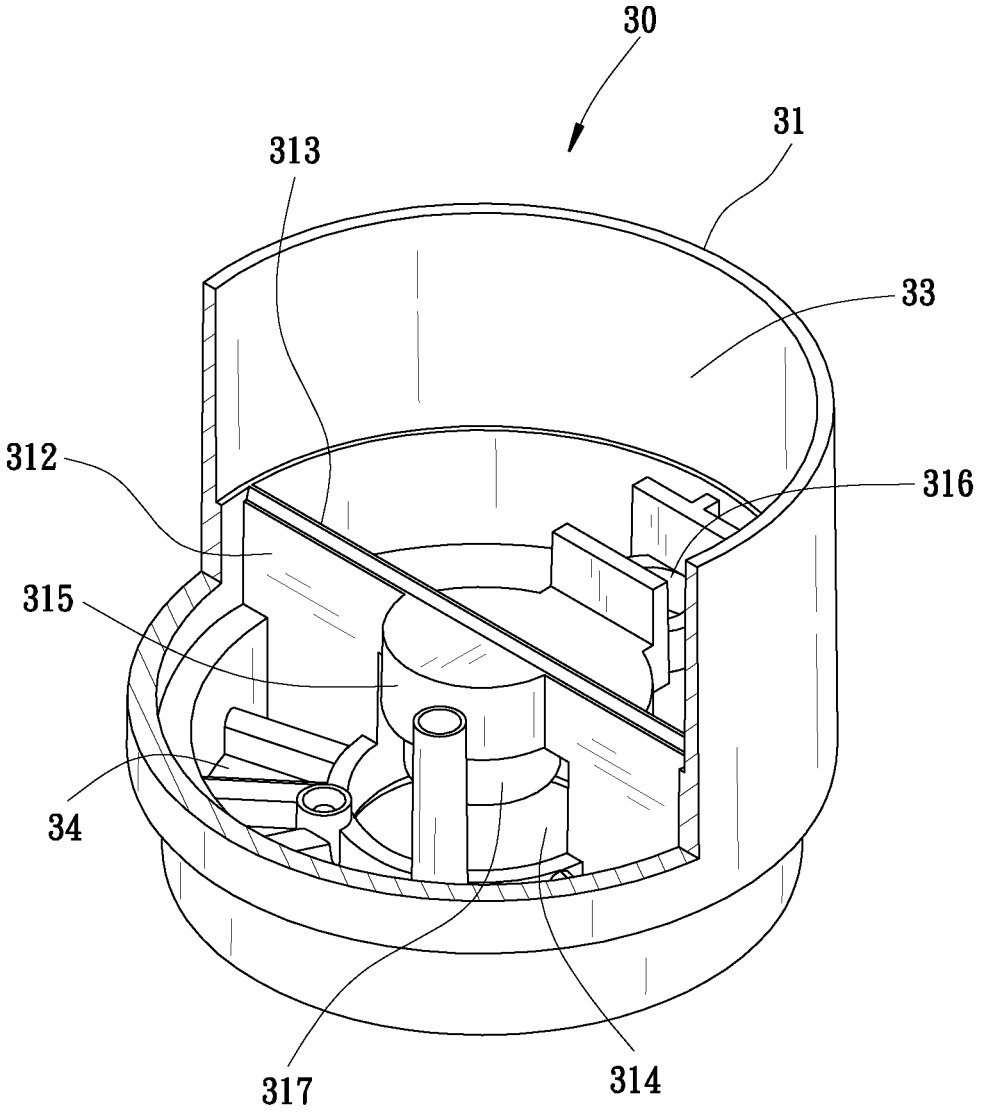
FIG. 5 is a perspective view of a movable set of an embodiment of the invention.
Figure 6:
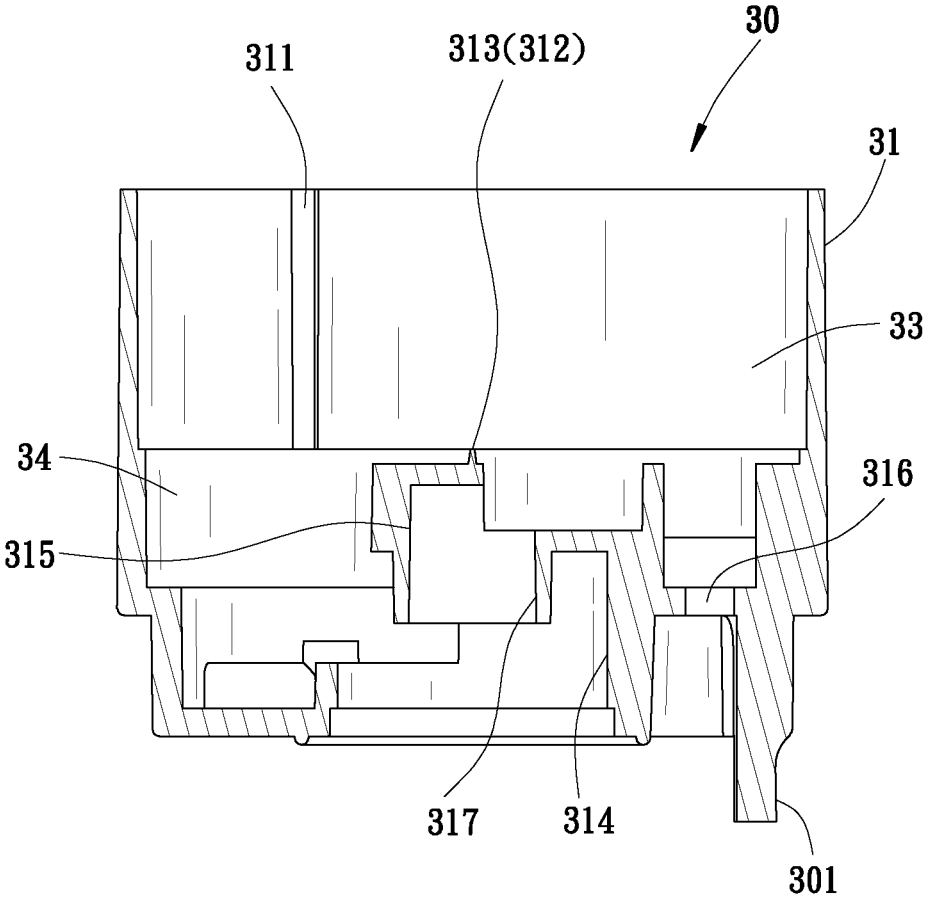
FIG. 6 is a cross-section view of the movable set according to FIG. 5.
Figure 7:
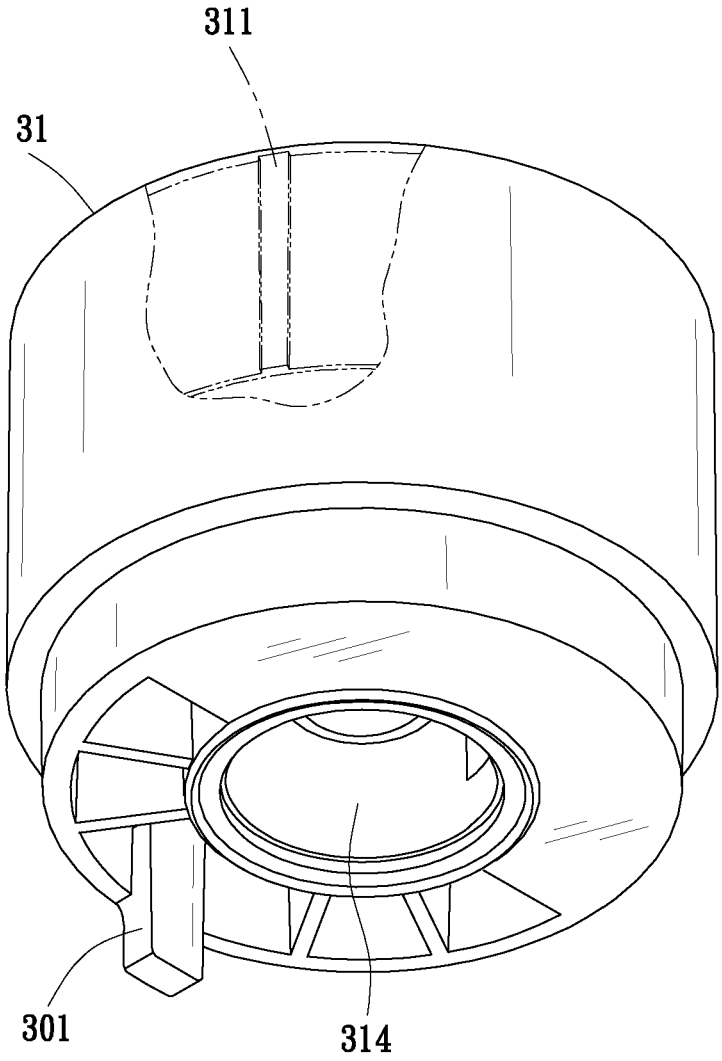
FIG. 7 is a perspective view from an end of the movable set according to FIG. 5.
Figure 8:
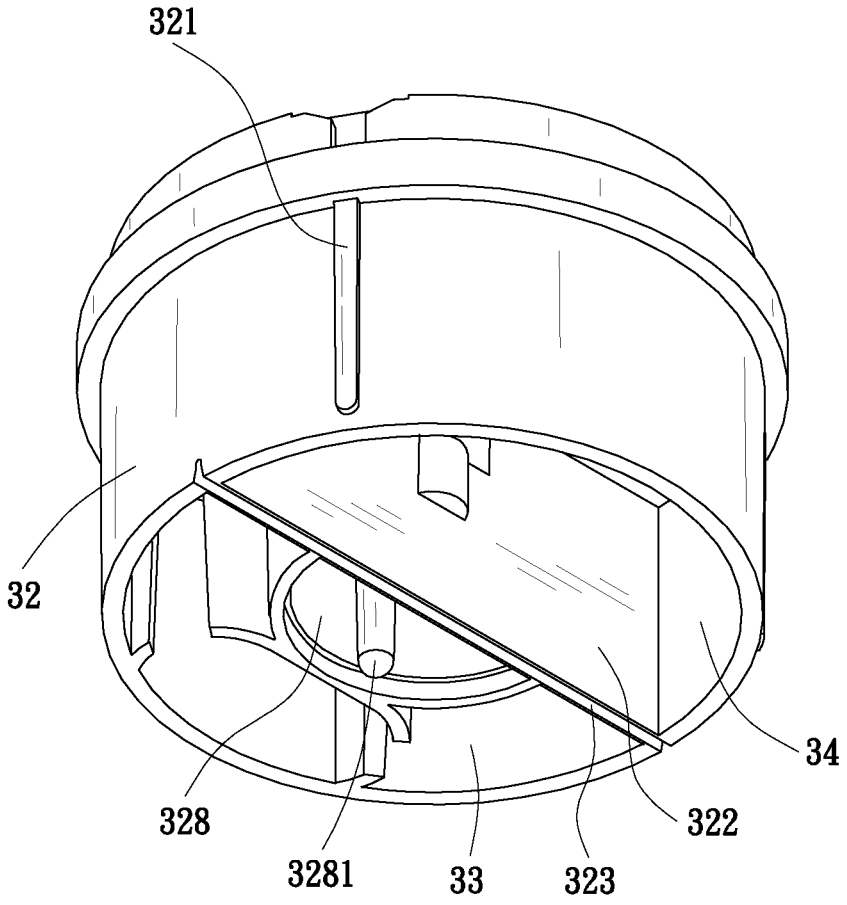
FIG. 8 is perspective view of the movable set with a lid according to one embodiment of the invention.
Figure 9:
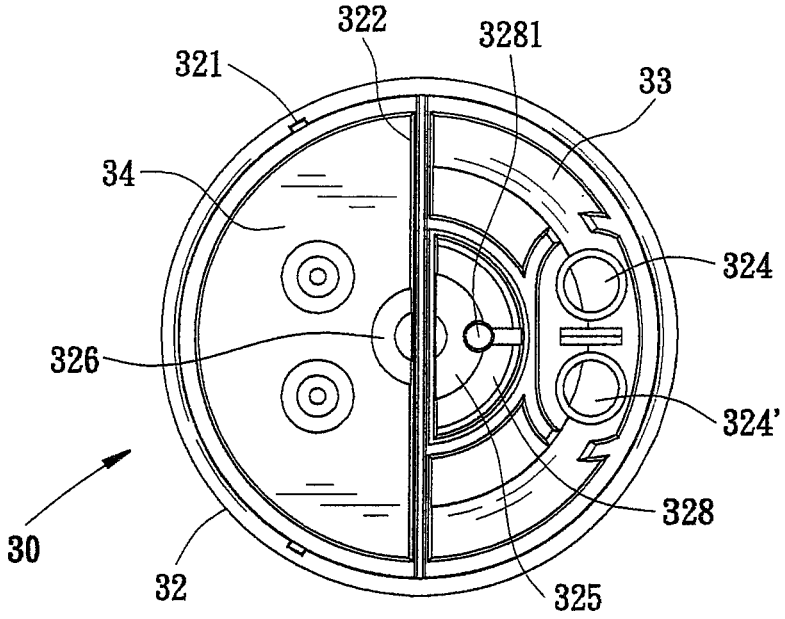
FIG. 9 is a cross-section view from a bottom end of the movable set according to FIG. 8.
Figure 10:
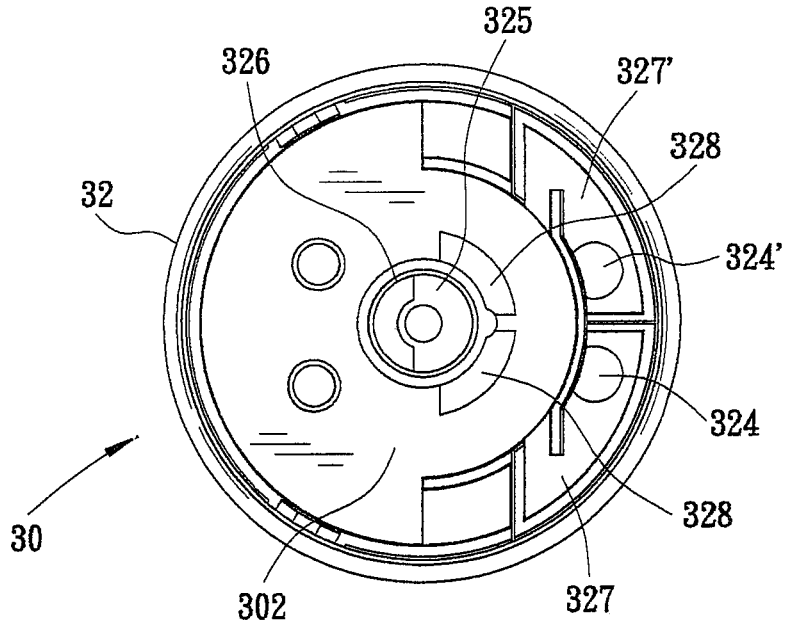
FIG. 10 is a cross-section view from the top end of the movable set according to FIG. 8.
Figure 11:
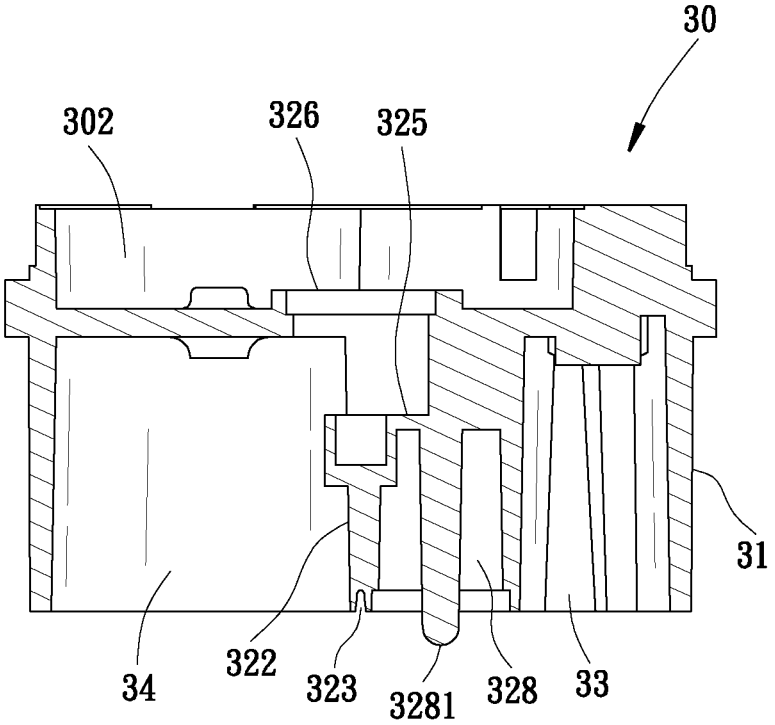
FIG. 11 is a cross-section view of the movable set according to FIG. 8.
Figure 12:
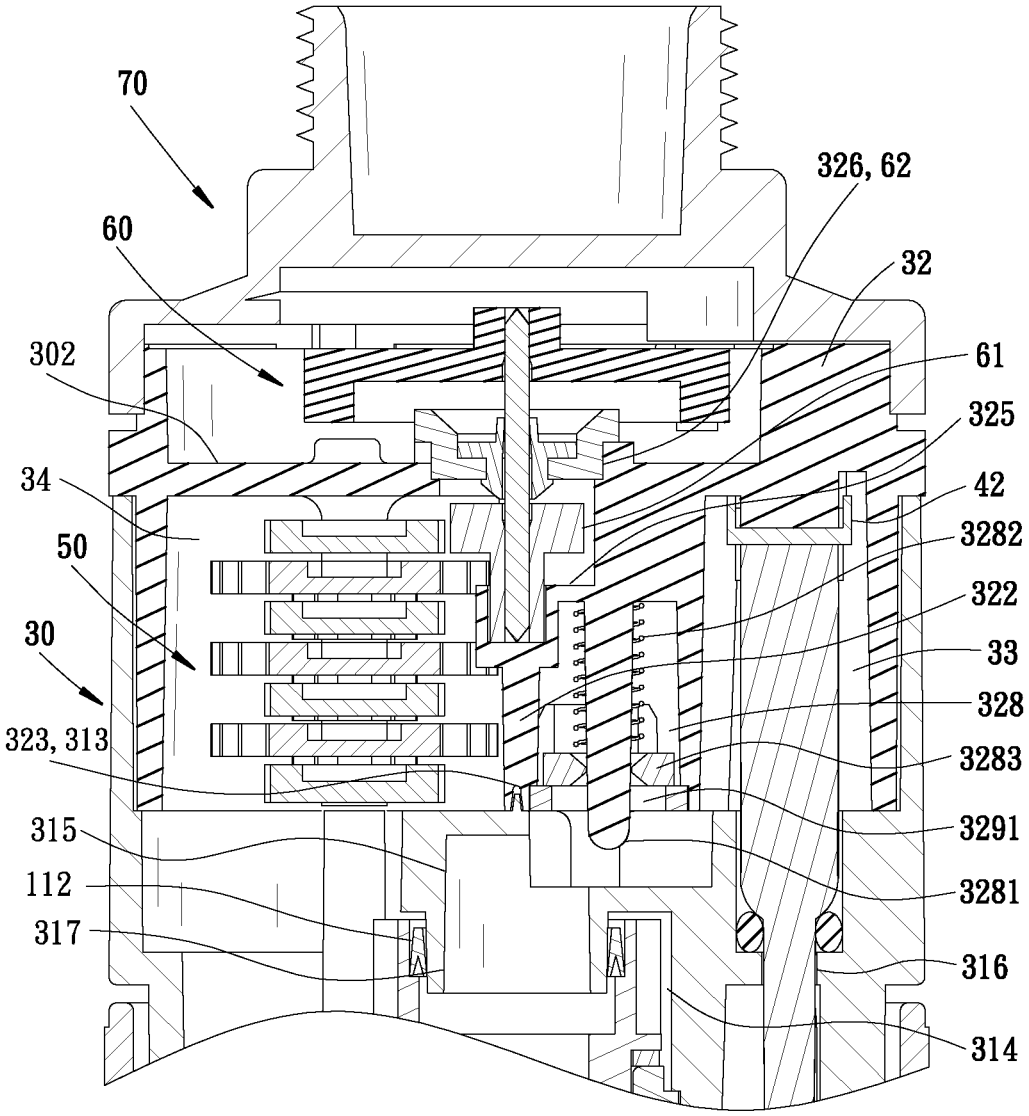
FIG. 12 is an enlarged cross-section view of one embodiment of the invention.

The following list shows reference characters used through FIGS. 1-12:

10—a water inlet;
11—a connecting pipe;
111—a stationary gear;
112—a restricting o-ring;
12—an adjustable valve;
121—an adjustable opening;
20—a restricting connector;
21—a restricting space;
30—a movable set;
301—a restricting handle;
302—a collecting space;
31—an end box;
311—wall groove;
312—a lower divider;
313—a first rib;
314—a first section;
315—a second section;
316—a hole;
317—a small diameter chamber;
32—a cover;
321—a second rib;
322—an upper divider;
323—a receiving groove;
324, 324'—openings;
325—a semi-circle space;
326—an opening;
327—a first duct;
327'—a second duct;
328—a water outlet space;
3281—a rod;
3282—a spring;
3283—a washer;
329—a release cover;
3291—a pressure release opening;
33—a control chamber;
34—a gear chamber;
35—a filtering space;
40—a water switching device;
41—a switching handle;
42—a moving piece;
50—a gear set;
51—a first set of gears;
52—a second set of gears;
60—a blade;
61—a driving gear;
62—a blocking member;
70—an outlet.

Referring to FIG. 1, a perspective view illustrates one embodiment of the invention. The following discussions of FIG. 1 should also refer to FIGS. 2-4 for parts or references illustrated therein. A sprinkler 100 is moved by a sprinkler control set to oscillate the sprinkler body based on an angle. The sprinkler control set includes a water inlet 10 which is connected to a water source. The water inlet 10 includes in its interior a connecting pipe 11 and an adjustable opening 121 connecting to an adjustable valve 12. The adjustable valve 12 thus can adjust the water flow. At the top of the water inlet 10, the water inlet 10 includes a restricting space 21 having a restricting connector 20 to provide a space for a movable set 30 having a restricting handle 301 and a water switching device 40. The water switching device includes a switching handle 41. The water switching device 40 is set one side of the movable set 30, and a moving piece 42 which is moved by the switching handle 41.

The other side of movable set 30 also includes a gear set 50. The gear set 50 includes a front set of gears 51 and a second set of gears 52. The front set of gears 51 and second set of gears 52 meet a blade 60 of a driving gear 61 and a stationary gear 111 of the connecting pipe 11. As such, the restricting handle 301 of the movable set 30, the switching handle 41, and the water switching device 40 can be correspondingly restricted of the oscillation within the restricting space 21 to a maximum angle and further restrict the switching handle 41 and the water switching device 40 to switch water flowing direction. This changes the rotational direction of the blade 60. This moves the gear set 50 and the second set of gears 52 to follow the rotation direction of the stationary gear 111 to change the rotation direction of the movable set 30 to further control the oscillation's maximum angle.

At the tope of the movable set 30, an embodiment includes an outlet 70 for the water to exit therefrom. The movable set 30 also includes an end box 31 and a cover 32, the end box 31 (please also refer to FIGS. 5-7) includes in on the interior side of the wall grooves 311 that will match with ribs 321 of the exterior wall of the cover 32 (please refer to FIGS. 8-11). This enables the cover 32 to close with the end box 31 inside the wall of the end box 31 of the movable set 30. The movable set 30 also, within the end box 31 and the cover 32, includes a corresponding lower divider 312 and an upper divider 322. The corresponding lower divider 312 and the upper divider 322 provide the space for the water switching device 40 (please also refer to FIG. 12) to be placed in a control chamber 33. The movable set 30 also includes a gear chamber 34 for housing the gear set 50.

At the one end of the lower divider 312 includes a rib 313 that matches to a receiving groove 323 of the upper divider 322, in which the receiving groove 323's dimension (width and depth) is slightly larger than the size of that of the rib 313. As such, the space between the matched rib 313 and the receiving groove 323 forms a space or duct to filter water in a filtering space 35. The filtering space 35 is accessible to a first section 314, which is semi-circular in shape, with the control chamber 33 under one side of the lower divider 312. The water in the filtering space 35 is also accessible to the gear chamber 34. The water in the filtering space 35 is also accessible on the other side connecting to the gear chamber 34, which includes a semi-circle second section 315, having a smaller size than that of the first section 314, which interconnects with the control chamber 33. In one embodiment, as the rib 313 of the lower divider 312 and the receiving groove 323 of the upper divider 322 meet, the lower divider 312 and the upper divider 322 may form a passageway. For example, the size of the rib 313 may fit exactly in the receiving groove 323 such that, as the rib 313 and the receiving groove 323 meet, each of the gear chamber 34 and the control chamber 33 is in a sealed or a substantially sealed chamber. In such an embodiment, the gear chamber 34 and the control chamber 33 each form a separate and independent space from one another. In this example, lubricants may be added to the gear chamber 34 such that the gear set 50 can be lubricated by the lubricants.

Hence, the top side of the first section 314 and the bottom side of the second section 315 extend a small diameter chamber 317 that connects to the control chamber 33 and the second section 315 and thus connected with the connecting pipe 11. Thus, the connecting pipe 11's stationary gear 111 can fit within the first section 314 and the gear chamber 34 and the second set of gears 52 can fit therewith, and the gear set 50 can be completely protected within the gear chamber 34 without subjecting the gear set 50 to external impact.

The connecting pipe 11 and the small diameter chamber 317 also include a restricting o-ring 112 to prevent water leaks. And this enables the connecting pipe 11's interior wall to be blocked by the second section 315 and the o-ring 112 and only be connected with or accessible to the control chamber 33. The water is then conducted to the connecting pipe 11, small diameter chamber 317, and the second section 315 to enter the control chamber 33.

The switching handle 41 has a hole 316 in a corresponding position on the end box 31 and the cover 32. Openings 324 and 324' are two water outlets on the top and the bottom ends of the control chamber 33. The moving piece 42 will move as it is supported by the switching handle 41 in the middle, and, as it moves, it will alternately cover the opening 324 and block the opening 324' or vice versa. At one side of the tope of the upper divider 322 near the control chamber 33, a semi-circle space 325 is connected with the gear chamber 34. The center of the exterior of the cover 32 includes an opening 326, and it is connected with the semi-circle space 325 and the gear chamber 34 to provide the driving gear 61 and the front set of the gears 51 of the gear set 50 to meet. The opening 326 is on top of the movable set 30 and is surrounded by the blade 60 which create a collecting space 302 to hold water. The collecting space 302 is connected to the openings 324 and 324', and the opening 324 includes a blocking member 62 between the blade 60 and the driving gear 61 and thus separating the collecting space 302 from the gear chamber 34. The collecting space 302 includes a first duct 327 and a second duct 327' that connects to the openings 324 and 324', respectively. This allows water to flow from the openings 324 or 324' to the ducts 327 or 327', respectively, before the water is collected at the collecting space 302.

When in the collecting space 302, the water pushes the rotation of the blade 60 and the driving gear 61, which in turn push the gear set 50 and the movable set 30 to make rotation of the stationary gear 111 before moving the switching handle 41 and the restricting handle 301. When reaching its maximum angle in the restricting space 21, the switching handle 41 will alternately move in the other direction when it reaches its movement limit. This it will leave the position to block the opening 324, for example, and changes the water flowing direction. At the same time, the switching handle 41 causes changes in the rotational directions of the blade 60, the driving gear 61 and the gear set 50 and thus causes the movable set 30 to oscillate to the other direction.

Also, the surrounding wall of the semi-circle space 325 includes a water outlet space 328 between the collecting space 302, and the sprinkler also includes a pressure release opening 3291, which includes a release cover 329 fitting the space 328. Within the outlet space 328, a rod 3281 is included therein and fits into the release opening 3291. A spring 3282 and a washer 3283 are also used. As the washer 3283 receives force from the spring 3282 and thus closes the release opening 3291, when the water pressure in the control chamber 33 increases, the water will push against the washer 3283 to actuate 3282 to open the release opening 3291 to enable some water to flow to the outlet space 328 through the release opening 3291. The water in the collecting space 302 will exit via the outlet 70 to achieve pressure relieving purpose. At the same time, by separating the gear chamber 34 from the control chamber 33 through the upper divider 322 and the lower divider 312, the connecting pipe 11 is only accessible to the control chamber 33, thus preventing water flowing into the gear chamber 34. Water with debris or sediments might accumulate within the gear chamber 34 under the prior technology, and the workings of the gear set 50 in the gear chamber 34 are negatively affected. Thus, as water flows to the control chamber 33, through the filtering space 35 created by the upper divider 322 and the lower divider 312 that seep into the gear chamber 34, the gear set 50 can be lubricated and cooled by the water, thus reducing damages due to friction between the gears. This further alleviates the water temperature difference and pressure differences in the control chamber 33 and the gear chamber 34. And the larger or more coarse particles of the water debris or sediments are blocked by the filtering space 35 and do not enter the gear chamber 34 to ensure optimal workings of the gear set 50. In another example, the filtering space 35 is able to filter impurities or finer sand such that filtered water or water with less impurities or debris may enter the gear chamber 34.

Also, the width of the receiving groove 323 is approximately larger than that of the rib 313 to form a narrow gap. The depth or height of the receiving groove 323 is greater than that of the rib 313 to form a larger duct. Thus, the debris in the water can flow through the narrower gap of the receiving groove 323 and the rib 313 before the larger duct of the receiving groove 323 and the rib 313 before reaching another narrower gap to enter into the gear chamber 34. This will create multiple filtering stages, which further prevents debris in the water from entering into the gear chamber 34.

Figure 13:
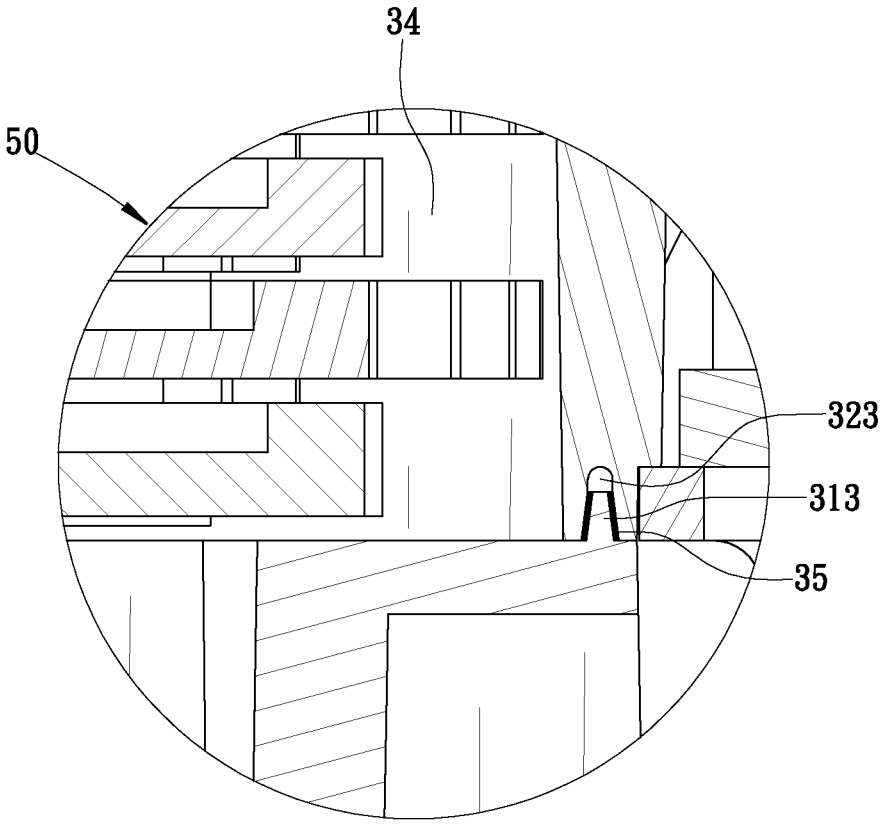
FIG. 13 is another cross-section view of a gear chamber according to an embodiment of the invention.

Referring now to FIG. 13, an illustration showing a cross-section view of a gear chamber, such as the gear chamber 34, of according to an embodiment of the invention. In this example, lubricant may be added to the gear chamber 34 such that the gear set 50 may function more efficiently and parts therein may operate more smoothly with reduced friction. Moreover, the rib 313 and the groove 323 with the lubricant may improve sealing of the filtering space 35, and the gear set 50 in the gear chamber 34 may form an independent space or chamber to prevent or avoid leaking of the lubricant. This embodiment further improves the operations of the parts herein described.

In operation, water enters the sprinkler from the water source through the water inlet 10 and the connecting pipe 11. The water next enters the movable set 30, which includes the set of dividers that separates the movable set 30 into the control chamber 33 and the gear chamber 34. The set of dividers thus can filter debris from the water that enters the gear chamber 34. According to one embodiment, this achieves the functions of cooling and lubricating of the gear chamber 34.

Although the invention has been explained in relation to its various embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

Having described the invention in detail, it will be apparent that modifications and variations are possible without departing from the scope of the invention defined in the appended claims.

When introducing elements of the embodiments(s) of the present invention, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions or products without departing from the scope of the invention, it is intended that all matter contained in the above description and shown in the accompanying drawing[s] shall be interpreted as illustrative and not in a limiting sense.

What is claimed is:

1. An improved sprinkler, said sprinkler includes a water switching device to change a water flow direction to control a blade and a direction of a gear set to oscillate a movable set, said sprinkler comprising: a set of an upper divider and a lower divider positioned within an interior of said movable set and dividing the interior of the movable set into a water control chamber and a gear chamber, said water control chamber including the water switching device therein, said gear chamber includes the gear set therein, wherein the movable set includes a bottom end, said bottom end of the movable set includes a connecting pipe with a stationary gear section, said stationary gear section meeting with a gear within the gear set, wherein the gear set is completely enclosed in the gear chamber, wherein water flowing inside the connecting pipe is accessible to the water control chamber only to direct water to the water control chamber, and wherein the upper divider and the lower divider comprise a set of a matching rib and a receiving groove that form a water filtering space to enable the water from the control chamber to flow through the filtering space before seeping through the gear chamber while filtering out larger or coarser particles in the water, assisting in cooling and lubrication of the gear set, preventing frictional damages between gears in the gear set and maintaining a balance in the water pressure and temperature between water in the water control chamber and the gear chamber.

2. The sprinkler of claim 1, wherein the movable set comprises an end box and a cover, wherein the upper divider and the lower divider are positioned on the cover and the end box, respectively.

3. The sprinkler of claim 2, wherein the end box comprises an internal wall, wherein the cover comprises an exterior wall, wherein a set of matching closure elements are positioned on the interior wall of the end box and the exterior wall of the cover such that the cover can be fixed within the inside of the movable set.

4. The sprinkler of claim 2, wherein the upper divider comprises a semi-circle space surrounding by a wall to form a water outlet space formed within and connected with a space on top of the cover, wherein the sprinkler further comprising a pressure release opening and a release cover fitting the pressure release opening, wherein the semi-circle space includes a rod to be inserted into the pressure release opening, said rod is fitted with a spring and a washer wherein said washer closes the pressure release opening in response to the washer receiving force from the spring.

5. The sprinkler of claim 1, wherein each of the receiving grooves having a width, said width is approximately larger than that of each of the ribs to form a narrow gap, wherein a depth or height of each of the receiving grooves is greater than that of each of the ribs to form a larger duct.

6. The sprinkler of claim 1, wherein the receiving groove of the upper divider and the rib of the lower divider further form a sealed water filtering space.

* * * * *